US009732280B1

(12) United States Patent
Hollar

(10) Patent No.: US 9,732,280 B1
(45) Date of Patent: Aug. 15, 2017

(54) BURNER KETTLE FOR ASPHALT PAVING APPARATUS

(71) Applicant: Casey D. Hollar, Stevens Point, WI (US)

(72) Inventor: Casey D. Hollar, Stevens Point, WI (US)

(73) Assignee: FABWORKS & SERVICES, LLC, Stevens Point, WI (US)

( * ) Notice: Subject to any disclaimer, the term of this patent is extended or adjusted under 35 U.S.C. 154(b) by 0 days.

(21) Appl. No.: 15/236,996

(22) Filed: Aug. 15, 2016

Related U.S. Application Data

(60) Provisional application No. 62/205,403, filed on Aug. 14, 2015.

(51) Int. Cl.

| | |
|---|---|
| ***B01F 7/20*** | (2006.01) |
| ***B01F 15/06*** | (2006.01) |
| ***C10C 3/12*** | (2006.01) |
| ***E01C 19/08*** | (2006.01) |
| ***B01F 7/00*** | (2006.01) |
| ***B28C 5/16*** | (2006.01) |

(52) U.S. Cl.
CPC ..... *C10C 3/12* (2013.01); *B01F 7/0025* (2013.01); *B01F 7/20* (2013.01); *B01F 15/065* (2013.01); *B28C 5/16* (2013.01); *E01C 19/08* (2013.01)

(58) Field of Classification Search
CPC .. B01F 15/065; B01F 7/18; B01F 7/20; B01F 7/0025; B01F 7/00258; B01F 7/00075; B01F 7/00041; B01F 7/165; B01F 7/00275; B01F 2215/0422; E01C 19/08; C10C 3/12; B28C 5/12; B28C 5/16
USPC .... 366/349, 325.1, 325.92; 404/92, 95, 113, 404/115, 116
See application file for complete search history.

(56) References Cited

U.S. PATENT DOCUMENTS 3,281,573 A 10/1966 Hynes et al.
3,681,566 A 8/1972 Sellers
(Continued)

FOREIGN PATENT DOCUMENTS

GB 803360 A * 10/1958 ..... C10C 3/12
WO 2007/035982 A1 * 4/2007

OTHER PUBLICATIONS

CRAFCO, EZ Series II Melter/Applications Brochure, © 2015 Crafco, Inc. Feburary #A 1022 (http://www.crafco.com/Portals/0/brochures/Crafco-E-Z-Series-II-Sealant-Melter-Applicator-Brochure.pdf?ver=2016-08-01-074007-530).
(Continued)

*Primary Examiner* — Charles Cooley
(74) *Attorney, Agent, or Firm* — Charles S. Sara; DeWitt Ross & Stevens, S.C.

(57) ABSTRACT

A burner system for heating the material product, i.e., asphalt, includes a burner kettle designed with a thicker bottom heat transfer plate, added heat transfer oil (HTO) circulation pumps, a spiral circulation ring and heat restriction rings. The spiral circulation ring spirals up the burner kettle to move the HTO around the entire circumference of the burner kettle to eliminate hotspots. An HTO pump moves cooler oil from the top of the kettle directly across the hottest part of the bottom of the kettle, i.e., across the heat transfer plate. Keeping this zone cool will eliminate heat stress of the material. Heat restriction rings direct the heat back and forth throughout the burner kettle for increased efficiency.

30 Claims, 7 Drawing Sheets

(56) References Cited

U.S. PATENT DOCUMENTS 3,841,527 A * 10/1974 Von Roeschlaub . E01C 23/0973 222/146.2
4,159,877 A 7/1979 Jacobson et al.
4,363,427 A * 12/1982 Crosby ..... E01C 19/08 222/146.2
4,415,267 A * 11/1983 Hill ..... E01C 19/08 366/137
4,423,980 A * 1/1984 Warnock ..... E01C 19/174 296/37.6
4,506,982 A * 3/1985 Smithers ..... B01F 7/00641 366/142
4,620,645 A * 11/1986 Hale ..... E01C 19/45 126/343.5 A
4,661,684 A 4/1987 Sellers
4,692,028 A * 9/1987 Schave ..... E01C 19/45 366/13
4,887,908 A 12/1989 Montgomery et al.
4,905,663 A 3/1990 Magee
5,765,963 A * 6/1998 Roberts ..... E01C 19/16 404/101
5,832,178 A * 11/1998 Schave ..... B05C 11/1042 126/343.5 A
5,974,227 A 10/1999 Schave
6,049,658 A 4/2000 Schave et al.
6,109,826 A * 8/2000 Mertes ..... E01C 19/45 392/472
6,663,016 B2 12/2003 Bien
7,008,136 B2 * 3/2006 Hill ..... E01C 23/0973 404/101
8,388,215 B2 3/2013 Kay et al.
9,132,570 B2 * 9/2015 Trimborn ..... E01C 19/08
2003/0062427 A1 * 4/2003 Bien ..... E01C 19/08 239/135

OTHER PUBLICATIONS

BearCat Mfg., BK-400D Kracker Brochure © 2001 BearCat Mfg, Inc. (http://www.bearcatmfg.com/html/krac/bk400d.html).
CPMG MAGMA GEN IV Brochure, Revised Jan. 2013, Cimline Pavement Maintenance Group (http://specialasphalt.net/application/files/8614/3078/9260/B_CIMLINE-MagmaGenIV_2-20142.pdf).

* cited by examiner

BURNER KETTLE FOR ASPHALT PAVING APPARATUS

CROSS-REFERENCE TO RELATED APPLICATION

The application claims priority to U.S. Provisional Application entitled "IMPROVED BURNER KETTLE FOR ASPHALT PAVING APPARATUS," Ser. No. 62/205,403, filed Aug. 14, 2015, which is incorporated herein by reference in its entirety.

FIELD OF THE INVENTION

The present invention is directed to asphalt pavers and specifically to apparatuses for filling cracks in pavement. More specifically, the present invention is directed to an improved burner system for heating the material product, i.e., asphalt.

DESCRIPTION OF PRIOR ART

Pavement crack filling is an asphalt maintenance procedure using equipment that melts a repair product and applies asphalt to the flaw in the base material to recondition the original material and prolong the life of the original material. There are three main manufacturers of crack filling equipment: Crafco, Bearcat and Cimline. Each company's product is different, but the purpose of use remains the same.

Reference is made to U.S. Pat. Nos. 5,832,178 and 6,049,658 to Schave et al. and U.S. Pat. No. 4,159,877 to Jacobsen, the entire disclosures of which are incorporated herein by reference, for a description of a typical asphalt crack sealing machine.

In addition U.S. Pat. No. 8,388,215 to Kay et al. discloses a modified asphalt reactor for blending and reacting asphalt cement and modifiers. A vertically-oriented vessel includes an outer shell having an external surface (the "external shell") that is jacketed for circulation of thermal heating oil. This configuration provides a heat transfer surface area and the high velocity of product across the surfaces enhances the rate of heat transfer. The mixture is circulated at a high rate through an impeller to mix contents thoroughly, providing homogeneity in both temperature and composition. A thermal oil heating system supplies heat transfer fluid for heating the reactor and asphalt cement preheater; it includes a circulating pump for circulation of heating oil.

U.S. Pat. No. 4,905,663 to Magee discloses an underfired kettle for heating rubberized asphalt with a concave material container for containing rubberized asphalt, an outer container spaced from and closed to the material container, a sinuous tube contained between the material container and outer container, one end of the tube being ported through the outer container, the tube containing spaced orifices in its sides along the length of its sides, and means for passing a burning gas into the port through the tube for heating air within the tube, whereby the air and exhaust of the burning gas can pass through the orifices and into the space between the material container and outer container, thereby heating a major portion of the material container and rubberized asphalt contained therein. The heating tube follows a meandering path over virtually the entire surface of the asphalt containing kettle in the space between the walls. Burning propane is introduced into one end of the tube, with air if required, add the resulting exhaust pass outwardly through spaced ports in the tube into the space between inner and outer jackets. Because the exhaust gases would create hot spots, with resulting charring of the rubberized asphalt located in the kettle adjacent the ports in the tube, deflectors are used above each of the ports in the tube, thereby spreading the exhaust over a broad area of the kettle surface within the cavity. In addition, the ports are spaced at decreasing distances from each other starting from the point at which the propane is introduced. This creates a more even heat distribution within the rubberized asphalt. A heavy wall thickness of the inner container is also preferred to be used, in order to disperse the heat as uniformly as possible.

The problems occurring on existing Manufacturer Model Crafco Ez Series Melters are that the kettles tend to burn out and leak heat transfer oil after approximately two years of heavy operation. The units are not built to accommodate everyday use all season long. The materials are not of adequate thicknesses to perform under strenuous conditions and for long periods of time.

SUMMARY OF THE INVENTION

The present invention is directed to an apparatus for heating a heatable material product such as asphalt or a similar fluid. The apparatus includes a heat exchanger for heating heat transfer oil, wherein the heat transfer oil is directed to the heat diffuser column. The apparatus further includes a burner barrel comprising (1) an exterior burner kettle barrel, wherein the burner kettle includes a bottom plate; an outer sidewall, an interior sidewall, and an closed top end; (2) a restriction baffle ring comprising a restriction baffle ring wall, including a lower end, an upper end, an interior surface, and an exterior surface with an outwardly extending lip, wherein the exterior surface comprises restriction baffles adapted to create a heat path for heating heat transfer oil circulating around the burner kettle apparatus, wherein the restriction baffle ring is nested within the burner kettle barrel to create an internal restriction baffle ring cavity containing the restriction baffles for receiving hot air supplied by the heat exchanger, (3) a heat diffuser column comprising a heat diffuser column wall, comprising an inner surface, an outer surface, a closed floor surface having an extended outward lip and an open top surface having an extended outward lip, wherein the outer surface of the heat diffuser wall comprises spiral ring, wherein the heat diffuser column is nested within the restriction baffle ring such that the upper and lower lips of the heat diffuser column sealingly engage with the interior surface of the restriction baffle ring to form a heat diffuser cavity including the spiral ring, wherein the heat diffuser cavity provides a flow path for the heat transfer oil from the heat exchanger around the burner kettle via the spiral ring; and (4) an agitator located within the heat diffuser column for activating the material product.

The present invention is further directed to a hot mix melt crack sealing apparatus comprising a trailer frame including a generally rectangular trailer frame body and a triangular tongue, wherein the trailer frame rests on a least one axle supported by wheels; a power unit for providing power to the apparatus; a series of hydraulic pumps activated by the power unit, wherein the hydraulic pumps supply hydraulic fluid to at least one asphalt material pump, an agitator motor, and a heat transfer oil circulation pump; and a heat exchanger for heating heat transfer oil. The apparatus further includes a burner barrel comprising (1) an exterior burner kettle barrel, wherein the burner kettle includes a bottom plate; an outer sidewall, an interior sidewall, and an closed top end; (2) a restriction baffle ring comprising a restriction baffle ring wall, including a lower end, an upper end, an interior surface, and an exterior surface with an outwardly extending lip, wherein the exterior surface comprises restriction baffles adapted to create a heat path for heating heat transfer oil circulating around the burner kettle apparatus, wherein the restriction baffle ring is nested within the burner kettle barrel to create an internal restriction baffle ring cavity containing the restriction baffles for receiving hot air supplied by the heat exchanger, (3) a heat diffuser column comprising a heat diffuser column wall, comprising an inner surface, an outer surface, a closed floor surface having an extended outward lip and an open top surface having an extended outward lip, wherein the outer surface of the heat diffuser wall comprises spiral ring, wherein the heat diffuser column is nested within the restriction baffle ring such that the upper and lower lips of the heat diffuser column sealingly engage with the interior surface of the restriction baffle ring to form a heat diffuser cavity including the spiral ring, wherein the heat diffuser cavity provides a flow path for the heat transfer oil from the heat exchanger around the burner kettle via the spiral ring; and (4) an agitator located within the heat diffuser column for activating the material product. Further, the apparatus includes at least one material asphalt pump for transferring molten asphalt material from the burner barrel to an applicator hose, an oven comprising application hoses and a control panel for controlling the power unit operation, material pump operation, temperature controls, burner box controls and agitator controls.

The present invention is further directed to an apparatus for heating a heatable material product such as asphalt or a similar fluid, comprising a heat exchanger for heating heat transfer oil, wherein the heat transfer oil is directed to the heat diffuser column, and a burner barrel. The burner barrel comprises (1) an exterior burner kettle barrel, wherein the burner kettle includes a bottom plate; an outer sidewall, an interior sidewall, and an closed top end, wherein the interior sidewall and exterior side wall of the exterior burner kettle barrel are separated by a cavity, wherein the cavity contains high temperature insulation; (2) a restriction baffle ring comprising a restriction baffle ring wall, including a lower end, an upper end, an interior surface, and an exterior surface with an outwardly extending lip, wherein the exterior surface comprises restriction baffles adapted to create a heat path for heating heat transfer oil circulating around the burner kettle apparatus, wherein the restriction baffle ring is nested within the burner kettle barrel to create an internal restriction baffle ring cavity containing the restriction baffles for receiving hot air supplied by the heat exchanger, and wherein the restriction baffles comprise a series of incomplete rings attached to the outer surface of the restriction baffle ring wall; (3) a heat diffuser column comprising a heat diffuser column wall, comprising an inner surface, an outer surface, a closed floor surface having an extended outward lip and an open top surface having an extended outward lip, wherein the outer surface of the heat diffuser wall comprises spiral ring, wherein the heat diffuser column is nested within the restriction baffle ring such that the upper and lower lips of the heat diffuser column sealingly engage with the interior surface of the restriction baffle ring to form a heat diffuser column cavity including the spiral ring, wherein the heat diffuser column cavity provides a flow path for the heat transfer oil from the heat exchanger around the burner kettle via the spiral ring, wherein the heat diffuser column further includes a center column extending from the floor surface for further circulation of heat transfer oil from the heat exchanger, and wherein the closed floor surface of the heat diffuser column comprises a series of inline slots to draw the material product through the closed floor surface of the heat diffuser column; and (4) an agitator located within the heat diffuser column for activating the material product, wherein the agitator comprises paddles rotating around a paddle shaft, wherein the paddle shaft is rotatably activated an agitator motor, and wherein the paddle shaft is rotatably placed within the center column of the heat diffuser column.

Advantageously, the burner kettle of the present invention is designed with a thicker bottom heat transfer plate, added heat transfer oil (HTO) circulation pumps, a spiral circulation ring and heat restriction rings. The spiral circulation ring will spiral up the kettle, as a spiral staircase would work, which will move the HTO around the entire circumference of the kettle to eliminate hotspots. One HTO pump will move cooler oil from the bottom of the kettle directly across the hottest part of the bottom of the kettle, i.e., across the heat transfer plate. Keeping this zone cool will eliminate heat stress of the material. Heat restriction rings direct the heat back and forth throughout the kettle. This keeps more heat in the system for increased efficiency, giving it direction of travel and making up for the heat transfer loss due to the thicker bottom heat transfer plate, creating more even heating. Safety switches and temperature controls will be incorporated to prevent accidental overheating or premature product movement.

This kettle system can be used for crack filling asphalt or concrete roads and driveways, as well as rubber roofing systems. The kettle will allow different material grades.

Thus, the improved burner kettle unit of the present invention is more user friendly, requiring less maintenance and less electronic controls. Parts and controls in the improved burner kettle system are easier to access and replace. The improved burner kettle unit has a longer life expectancy, with improved efficiency and improved user operation.

The objects and advantages of the invention will appear more fully from the following detailed description of the preferred embodiment of the invention made in conjunction with the accompanying drawings.

DETAILED DESCRIPTION OF THE INVENTION

Figure 1:
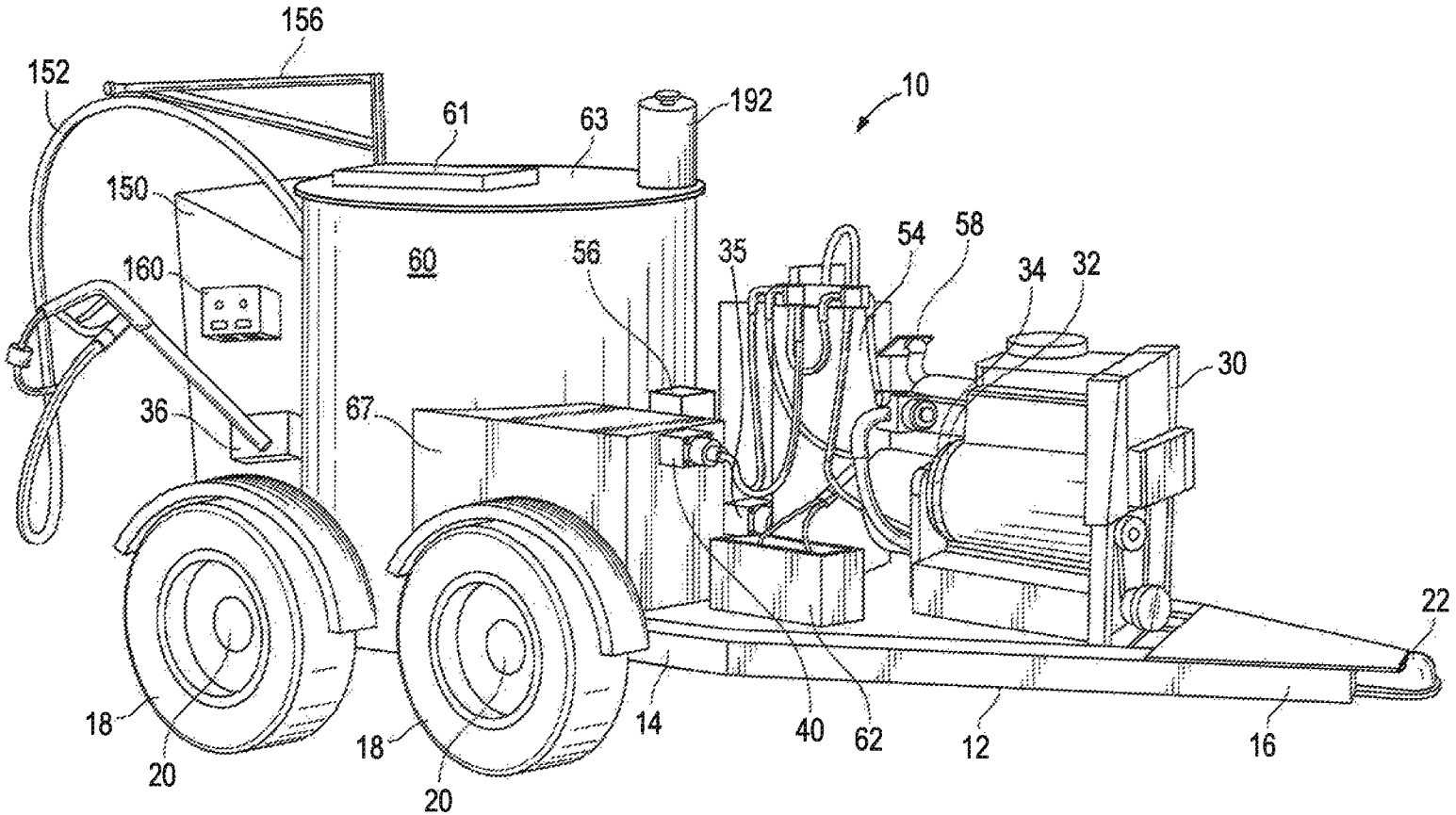
FIG. 1 is a front left perspective view of the asphalt burner of the present invention.
Figure 2:
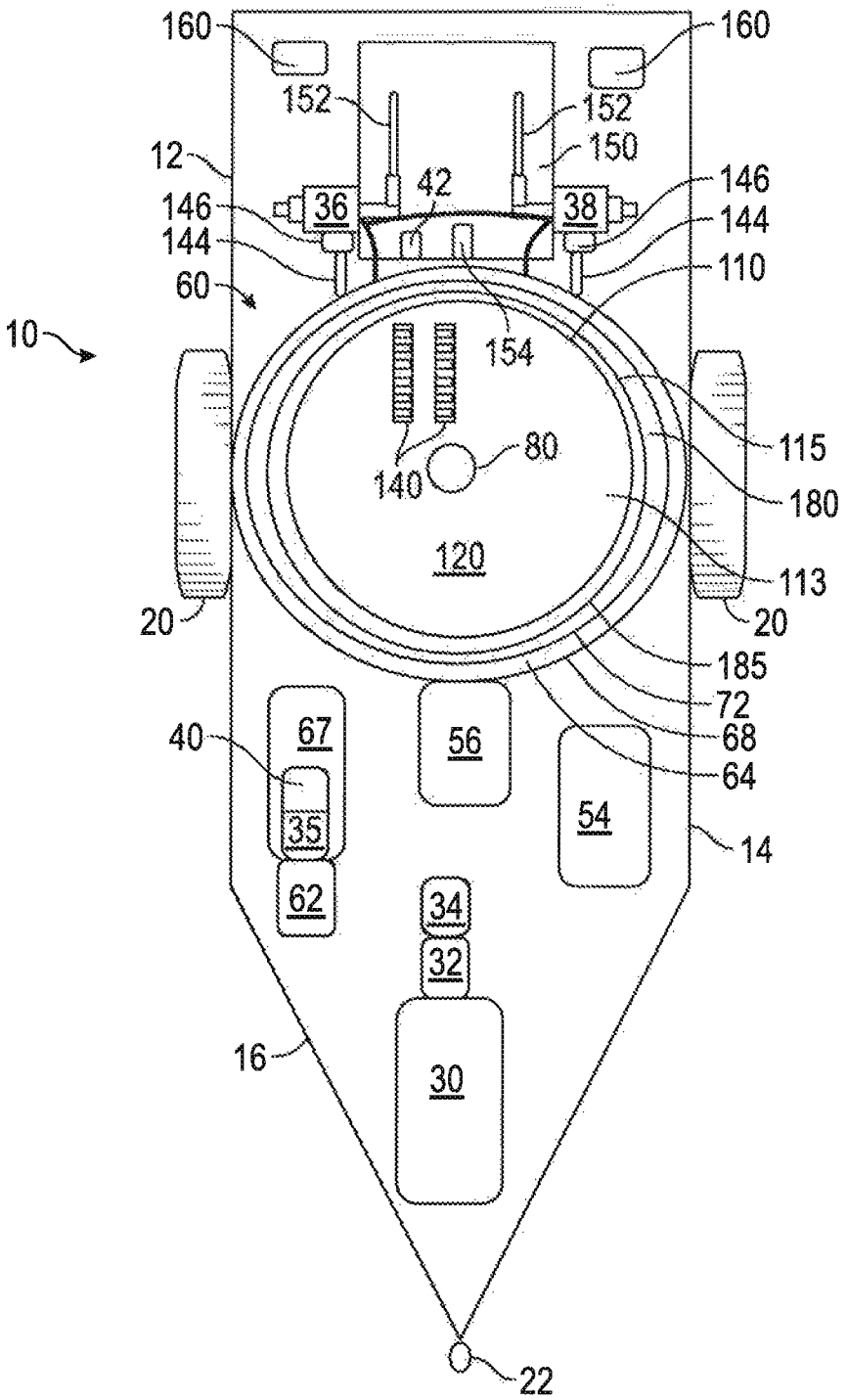
FIG. 2 is a top plan view of the asphalt burner unit of FIG. 1.

The present invention is directed to a new and improved hot mix melt asphalt crack sealing machine for controllably heating a solid or fluid form of a material product and dispensing a heat flowable material as a hot melt material. Such material product includes, but is not limited to, bitumen, tar, an asphalt mixture, resins, thermoplastics or other materials capable of becoming flowable when heated. For purposes of this disclosure, such materials will be reference as "asphalt," "asphalt material," or "material product." In addition, the present invention is directed to the concept of replacing the entire burner kettle and burner box in a machine, in which the kettle and burner box have degraded or "burned out" from constant use, with a superior burner kettle/burner box combination. Reference is made to the drawings, and particularly FIGS. 1 and 2, which illustrates the hot mix melt asphalt crack sealing apparatus 10.

The Frame 12:

The asphalt paving apparatus 10 includes a trailer frame 12 generally made from four inch I-beams for a stronger frame, with square tube and/or angle cross members. The trailer frame generally includes a generally rectangular trailer frame body 14 and a triangular tongue 16. The trailer frame body 14 rests on a least one and preferably two axles 18 supported by wheels 20 to enable the apparatus 10 to be trailered or towed by a vehicle (not illustrated). The triangular tongue 16 includes a trailer hitch 22 for connection to the vehicle.

The trailer frame 12 on which the apparatus 10 resides typically includes tandem eight bolt 6,000 lb torsion axles 18. The trailer frame 12 can be wired to customer specifications, (i.e. strobe lights). The trailer frame 12 will include a standard lighting package, with DOT approved LED lights and plug configuration which will be specific to customer requirements. The trailer frame 12 will be set up for electric drum brakes. The entire unit, to include trailer, kettle and all related components will be painted blue and/or lime green. The trailer frame 12 will be built out of 4" I beam which is stronger than C channel.

The Power Unit 30:

Situated on the frame 12 is a power unit 30 for providing power to the apparatus 10. The power unit 30 can be any of several power units known to the art. A representative power unit is a 27.5 horsepower, three-cylinder Isuzu Diesel engine designed to power two hydraulic pumps 32, 34, and 35. The power unit 30 is mounted on the tongue 16 of the trailer frame 12 and is typically and preferably covered with a 16 gauge formed steel cover. A diesel fuel tank 54, preferably a 45 gallon tank, is mounted on the frame 12 for supplying the power unit 30 and the burner box 62 with fuel.

Hydraulic Pumps 32, 34, 35

The hydraulic pumps 32, 34, 35 are attached to and activated by the power unit 30. Hydraulic pump 32 is used to supply hydraulic fluid to material pump 36. Hydraulic pump 34 is used to supply hydraulic fluid to material pump 38. Hydraulic pump 35 is used to supply hydraulic fluid to the agitator motor 50, the conveyor motor (not illustrated) and the heat transfer oil pump motor 39, which operates HTO circulation pump 40, illustrated in FIG. 2.

Hydraulic Tank 56

The hydraulic tank 56, preferably a 30-gallon tank, is mounted on the frame 12. An electric operated hydraulic fluid cooler 58 is also preferably mounted near hydraulic tank 56 and will optimize the operation temperature of the hydraulic fluid.

Figure 3:
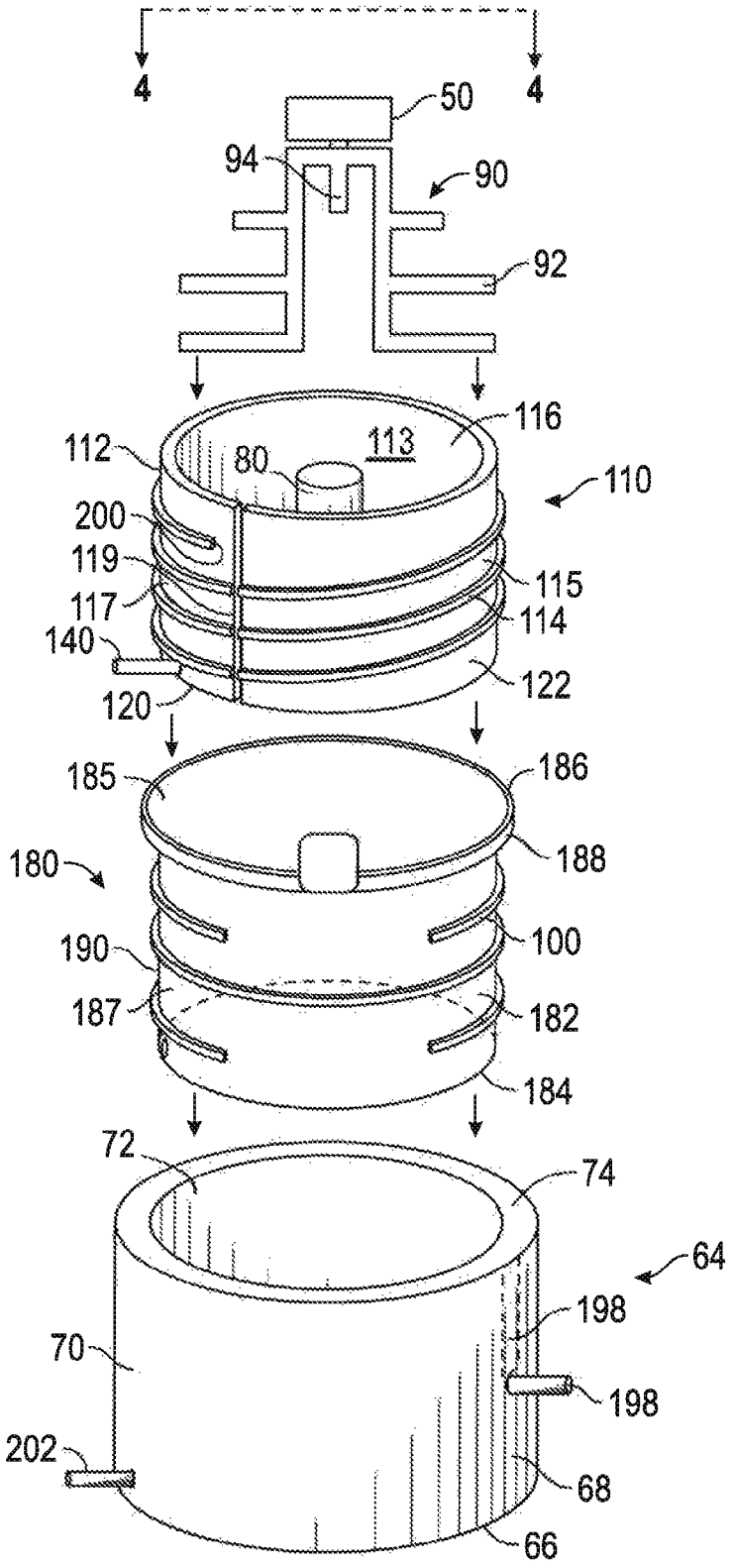
FIG. 3 is an exploded view of the burner box illustrating the component parts.
Figure 4:
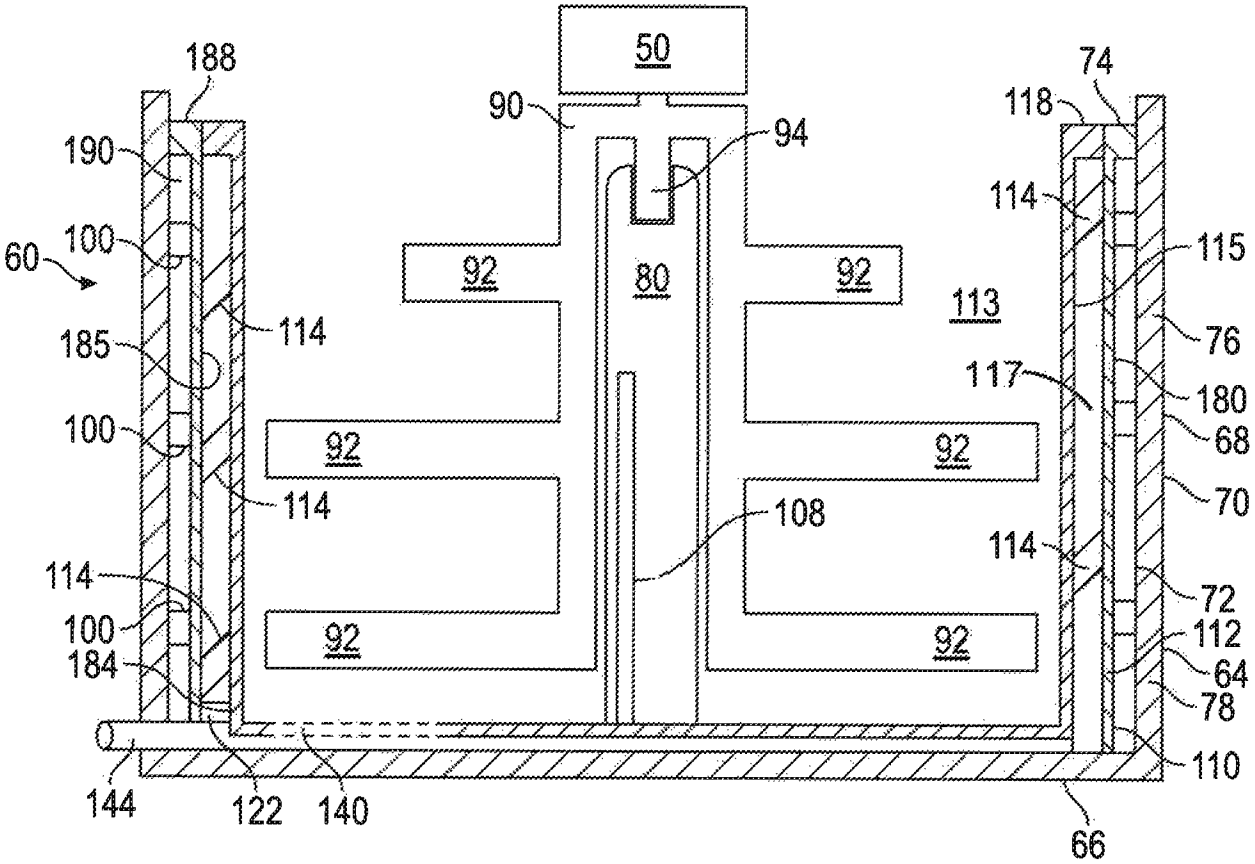
FIG. 4 is a cross-sectional view of the burner box of FIG. 3 taken at lines 4-4 in FIG. 3.
Figure 5:
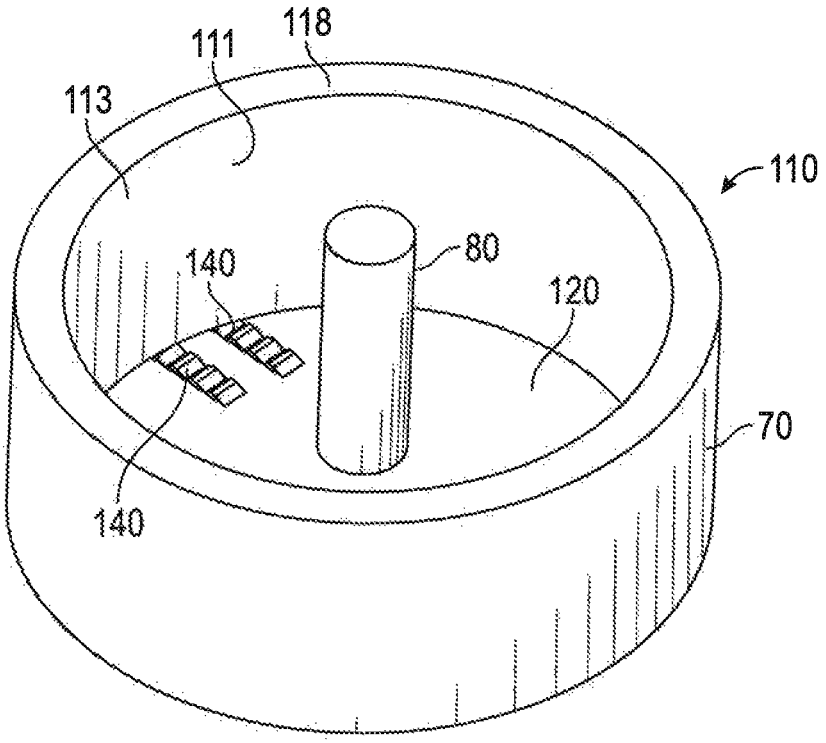
FIG. 5 is a perspective view of the heat diffuser column of the present invention.
Figure 6:
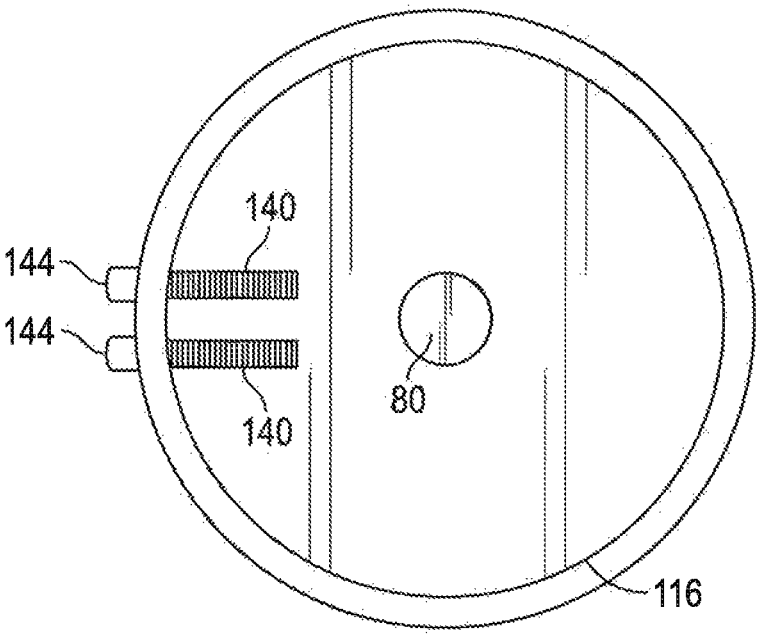
FIG. 6 is a top plan view of the heat diffuser column of FIG. 5.
Figure 7:
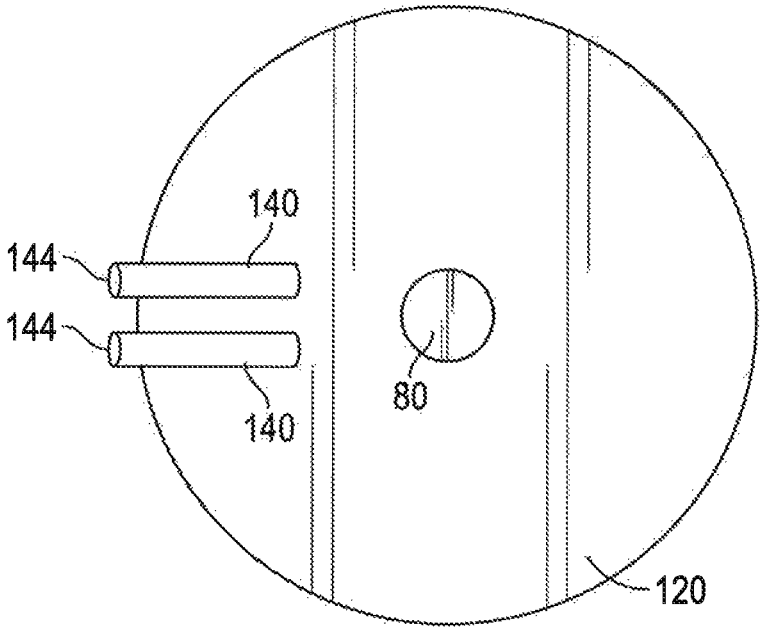
FIG. 7 is a bottom plan view of the heat diffuser column of FIG. 5.

The Burner Barrel 60:

The burner barrel 60 is used to melt material product, i.e., rubberized tar products for crack sealing roads. Referring specifically to FIGS. 3 and 4, the burner barrel 60 is a series of nested containers comprising an exterior kettle barrel 64, which enclosed a restriction baffle ring 180 of similar shape. A heat diffuser column 110 also of similar shape is nested within the restriction baffle ring 180 to form the burner barrel 60. As illustrated, the burner barrel 60 is typically a cylindrical bowl shape although it is within the scope of the present invention to provide the burner barrel 60 with a variety of shapes from oblong or oval to square, hexagonal, octagonal and other shapes. The burner barrel 60 is preferably bolted to trailer frame 12 for easier maintenance in the event something would need to be repaired either to the trailer 12 or burner barrel 60. Referring specifically to FIGS. 1 and 3, the burner barrel 60 is mounted directly over the axles 18 of the trailer frame 12. This is where the bulk of the weight will be located.

As will be described, the burner barrel 60 is a double boiler kettle system, where the diesel burner box 62 acts in concert with a heat exchanger 67, which automatically raises or lowers the temperature of air and HTO to a desired level, to heat the heat transfer oil (HTO). While heat exchangers are known to the art for other industry applications, it is not thought that a heat exchanger has been heretofore been used in this application. HTO is typically a high-quality mineral oil known to the art and developed for use in liquid-phase heat transfer systems. A representative example of a HTO for use in the present invention is THRIVE heat transfer oil (US Lubricants, Appleton, Wis.).

Burner Kettle 64

The burner kettle 64 is preferably manufactured of A36 steel components, but can be made of other heat resistance materials known to the art. The burner kettle 64 preferably includes a ⅜" thick A36 steel on the entire bottom plate 66 where the flame contacts the burner kettle 64 unit, eliminating burn out. The sidewall 68 and remaining kettle components are made of ¼" A36 steel. The outer covering is 16 gauge A36 steel. The burner kettle 64 includes an outer sidewall 70 and an interior sidewall 72, an open top end 74 and bottom plate 66. The interior sidewall 72 and exterior side wall 70 are separated by a burner cavity 76, which is insulated with flexible ceramic type high temperature insulation 78.

Restriction Baffle Ring 180

The restriction baffle ring 180 comprises a heavy gauge metal, e.g., steel, baffle ring wall 182 having a lower end 184, an upper end 186, an interior surface 185, and an exterior surface 187 with an outwardly extending lip 188. Located on the baffle ring wall 182 are restriction baffles 100, a series of incomplete rings adhered/welded to the baffle ring wall 182 designed to create a path for the heat to be directed back and forth through the burner kettle 60 in order to heat the HTO. The restriction baffle ring 180 is inserted within the burner kettle 64 thereby creating a baffle ring cavity 190 resulting in more even heating and efficiency. The hot air is supplied via the heat exchanger 67 at the bottom end 184 of the restriction baffle ring 180, via a series of heat exchanger pipes extending from the heat exchanger 67 to the restriction baffle ring 180. The hot air rises in a diversionary route caused by the restriction baffles 100 and eventually exiting via chimney 192. The result is an even, intense heat throughout the baffle ring wall 182 and the baffle ring cavity 190. The heated air flowing through the baffle ring cavity 190 will continue to keep HTO heated thereby providing an efficient mechanism for melting the asphalt block when it is placed with the inner chamber 113 sufficient to heat the HTO without causing unwanted heat spots throughout the burner barrel 60.

Heat Diffuser Column 110:

Referring to FIGS. 2-7, the heat diffuser column 110 includes a wall 112 defined by a spiral metal, e.g. steel, ring 114 around the outer surface 115 of the wall 112. The heat diffuser column 110 is characterized by an inner surface 111, an open top end 116 with an extended upper lip 118 and a closed bottom end 120 with an extending lower lip 122. The heat diffuser column 110 is designed to slidably fit within the interior surface 185 of the restriction baffle ring 180 such that the upper and lower lips 118, 122 of the heat diffuser column 110 sealingly engage with the interior surface of the restriction baffle ring 180 to form a heat diffuser cavity 117, which encapsulates the spiral ring 114 within the heat diffuser cavity 117. Together with the exterior surface 187 of the baffle ring wall 182 of the restriction baffle ring 180, the wall 112 of the heat diffuser column 110 form the heat diffuser cavity 117 to provide a flow path for the HTO around the burner kettle 60 via the spiral ring 114 for more consistent heating. The heat diffuser column 110 further includes a center column 80 for further circulation of the HTO as is described below with respect to the HTO Circulation Pump 40.

As illustrated in FIGS. 2 and 4-6, located on the bottom plate 120 of the heat diffuser column 110 are a series of inline slots 140 to draw the asphalt product through the bottom plate 120 of the heat diffuser column 110. The inline slots 140 open to an exit pipe 144, which transfers molten asphalt to each material pump 36, 38, which pumps the asphalt material either through the applicator hose 152 to be applied to the roadway or pumped back to the burner kettle 60 as desired.

A vented expansion tank/reservoir (not shown) provides a small reservoir in case of over filling with HTO and air movement for expansion and contraction of HTO when the heated HTO expands or the cooled HTO contracts. Keeping the HTO flowing and moving along the heat diffuser cavity 117 of the burner kettle 60 will result in more even heating and elimination of hot spots, improving longer life of both the burner kettle unit 60 as well as the HTO. In addition, a standard dipstick 119 can be provided to measure the level of HTO in the heat diffuser cavity 117.

Agitator 90

An agitator 90, illustrated in FIGS. 3 and 4, is needed to stir the material product, i.e., asphalt, while it is heating. The agitator 90 typically includes paddles 92 rotating around a paddle shaft 94 and driven by a hydraulically-activated agitator motor 50 operated by the power unit 30 according to systems well known in the industry. As illustrated in FIG. 3, the paddle shaft 94 is designed to rotatably fit within the center column 80 of the heat diffuser column 110. The paddles 92 are preferably formed from angle iron steel to create an upward angle flow path during agitation.

HTO Circulation Pumps 40:

The burner barrel 60 includes HTO circulation pump 40, to circulate the HTO across the burner box 62 to maximize heat transfer prior to the HTO flowing into the burner barrel 60. The HTO circulation pump 40 keeps cooler HTO flowing over the burner box 62, the direct area where the burner flame contacts the surface (hot spot) forcing it up the spiral around the burner kettle 60 to eliminate hotspots from the burner box 62.

HTO circulation pump 40 circulates HTO to each material pump 36, 38 in order provide elevated heat to the material pumps 36, 38 to keep the asphalt in a hot molten state for application. The return 108 from HTO circulation pump 42 is plumbed from the burner box 62 area of the burner kettle 60 thereby pulling HTO through the system and eliminating hotspot areas.

Loading the Burner kettle 60

Loading the burner kettle 60 with product is accomplished by means of a hatch 61 on the roof 63 of the burner kettle 60. The hatches 61 will be on the top at an angle where the material can be loaded on the hatch 61. When the hatch lid 65 is closed, the asphalt material enters the burner kettle 60 which will reduce splash back to the operator.

Alternatively, a conveyor system (not shown), known to the art, may be attached to the apparatus 10 for conveying the hardened asphalt block from a storage area directly to hatch 61 for placement into the heat diffusion column 110 of the burner box. The conveyor for loading asphalt blocks is typically hydraulically controlled. A conveyor will allow transfer of raw materials from a supply truck to the hatch 61 on the kettle barrel 60.

Material Pumps 36, 38

The asphalt will be directed from the inline slots 140 through pipes 144, preferably two-inch pipes, to material supply pumps 36, 38, known to the art. The material supply pumps 36, 38 are helical gear pumps with a jacketed housing for HTO to heat the pumps 36, 38. The pumps 36, 38 are reversible hydraulically to pull unused material back into the burner kettle 60 for shut down, bypass piping from pump back to the burner kettle 60 for warm up and added circulation. Mainline material valves 144, between the pumps 36, 38 and the burner kettle 60, will hold material back during shutdown and start up. Removable Screens 146 will keep foreign debris from damaging pumps.

Oven 150

The oven 150 is an insulated box on the back of the apparatus 10 and connected to the burner kettle 60. Ovens 150 are known to the art. The oven 150 heats the application hoses 152. The oven 150 is heated from the hot air created by the burner box 62 through a small opening (not illustrated) on the bottom at the back of the burner kettle 60, which will have a damper 154 to control oven temperature. The oven 150 includes a temperature gauge (not illustrated) for oven temperature readout. The oven 150 will hold the application hoses 152 and warm them up, as well as keep them warm in between uses.

Pivoting arms 156 attached to the application hoses 152 while in use keep the hoses 152 off the ground and ease user mobility. The arms 152 will slide in and out as well as swing 360 degrees around the apparatus 10. At the top of the burner kettle 60 there will be ports for recirculation of product through the application hose/wand 152, by inserting the end into the port and pumping the material as it is in use will heat application hose(s) during idle and warm up time. The application hoses 152 will be made of one inch flexible stainless steel transfer hose with an insulated fabric sleeve. A stainless steel tube for the application hose 152 will have a handle and flow control valve.

The control panel operation 160 will be located in the rear of the apparatus 10 and will control the power unit 36 operation, the material pumps 36, 38, the temperature controls, burner controls and agitator controls. The burner box 62 assembly will be removable.

Options include, but are not limited to, hitch type, hitch extensions, air compressor unit, propane tank mounting, conveyor loading, gauges, strobe lighting, plug-in HTO heater for extended down time, fire extinguisher, toolbox and other components.

In operation, the apparatus 10 is activated by turning the power unit 30 on. At this point, the burner box 62 is not activated. However, the burner box temperature is set to a preferable temperature of 550° F. via the control panel 160 and the burner box 62 is activated. Likewise, the HTO temperature sensor 46 is set to a preferable temperature between about 350° F. and 395° F. All HTO valves are opened to allow circulation of HTO according to the process described with respect to FIG. 8. The asphalt product is added to the burner kettle 60 for heat and melt according to processes known to the art. The agitator motor 50 is activated thereby placing the agitator 90 in motion. Once the asphalt product has liquefied properly, it flows from the burner kettle 62 by way of the in line slots 140 and exit pipe 144 for transport to the applicator hoses for application.

Figure 8:
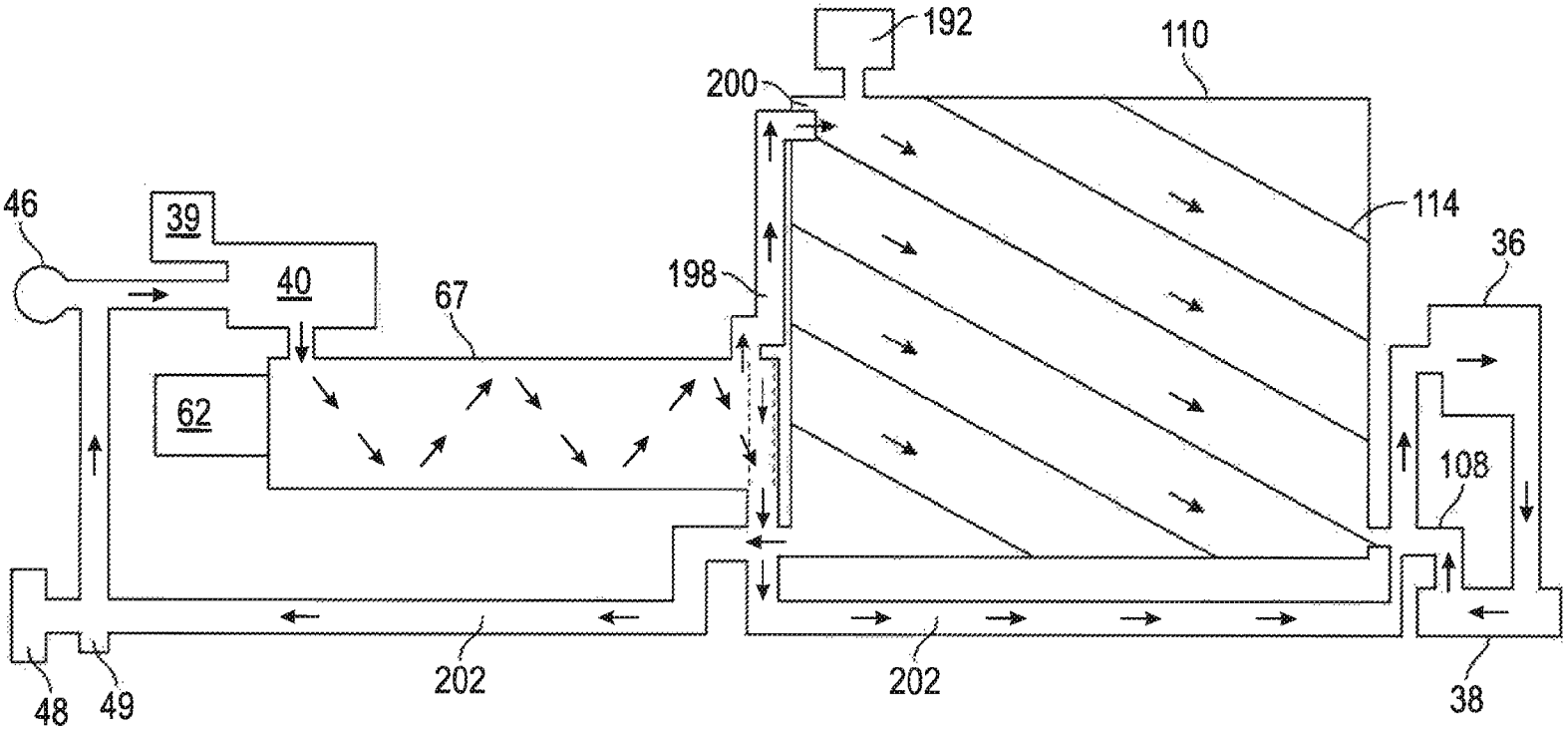
FIG. 8 is a schematic flow chart illustrating the flow of heat transfer oil through the system of the present invention.

Reference is now made to FIG. 8 to describe the process for heating the burner kettle 60. As illustrated in FIG. 8, the HTO process is a closed vented circuit flow system. HTO is pumped into the heat exchanger 67 via the HTO pump 40. The HTO pathway is illustrated by way of the arrows in FIG. 8. The heat exchanger 67 heats the HTO to an approximate temperature of 550° F. Heated HTO then flows to the heat diffuser cavity 117 via supply line 198 where it enters the heat diffuser cavity 117 at location 200. The heated HTO flows through the heat diffuser cavity 117 in a downwardly direction along spiral ring 114 thereby providing heat to the heat diffuser column 110 preferably to a temperature of 550° F. When the HTO reaches the lower end 120 of the heat diffuser column 110, the HTO passes into an exit pipeline 202 for recirculation back to the HTO circulation pump 40. A drainage port (not illustrated) may be placed in the pipeline 202 to remove HTO as needed.

Simultaneously with the heating of the HTO in the heat exchanger 67, the heat exchanger 67 heat air which is vented into the baffle ring cavity 190 of the restriction baffle ring 180 for providing additional heat to the inner chamber 113 of the heat diffuser column 110.

The HTO temperature sensor 46 reads the temperature of the HTO back to the control panel 160 where a digital controller is located and, if needed, the burner box 62 will automatically switch on or off, at a set desired temp of approximately 550 OF.

The HTO temperature sensor 46 reads back to the control box 160, where there is another digital controller, which is normally set at a desired temperature between about 350° F. and 395° F. This control will allow the switches on material pump 36, material pump 38 and agitator 50 to turn on if in an automatic position, thereby allowing material flow and circulation for warm up and normal operation.

Any version of any component or method step of the invention may be used with any other component or method step of the invention. The elements described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference in their entirety to the same extent as if each individual reference were specifically and individually indicated as being incorporated by reference. In case of conflict between the present disclosure and the incorporated references, the present disclosure controls.

The devices, methods, compounds and compositions of the present invention can comprise, consist of, or consist essentially of the essential elements and limitations described herein, as well as any additional or optional steps, ingredients, components, or limitations described herein or otherwise useful in the art.

While this invention may be embodied in many forms, what is described in detail herein is a specific preferred embodiment of the invention. The present disclosure is an exemplification of the principles of the invention is not intended to limit the invention to the particular embodiments illustrated. It is to be understood that this invention is not limited to the particular examples, process steps, and materials disclosed herein as such process steps and materials may vary somewhat. It is also understood that the terminology used herein is used for the purpose of describing particular embodiments only and is not intended to be limiting since the scope of the present invention will be limited to only the appended claims and equivalents thereof.

The invention claimed is:

1. An apparatus for heating a heatable material product such as asphalt or a similar fluid, comprising:

a. a heat exchanger for heating heat transfer oil, wherein the heat transfer oil is directed to a heat diffuser column;

b. a burner barrel comprising:

i. an exterior burner kettle barrel, wherein the burner kettle includes a bottom plate; an exterior sidewall, an interior sidewall, and an closed top end between the sidewalls;

ii. a restriction baffle ring comprising a restriction baffle ring wall, including a lower end, an upper end, an interior surface, and an exterior surface with an outwardly extending lip, wherein the exterior surface comprises restriction baffles adapted to create a heat path for heating heat transfer oil circulating around the burner kettle apparatus, wherein the restriction baffle ring is nested within the burner kettle barrel to create an internal restriction baffle ring cavity containing the restriction baffles for receiving hot air supplied by the heat exchanger;

iii. the heat diffuser column comprising a heat diffuser column wall, comprising an inner surface, an outer surface, a closed floor surface having an extended outward lip and an open top surface having an extended outward lip, wherein the outer surface of the heat diffuser wall comprises spiral ring, wherein the heat diffuser column is nested within the restriction baffle ring such that the upper and lower lips of the heat diffuser column sealingly engage with the interior surface of the restriction baffle ring to form a heat diffuser cavity including the spiral ring, wherein the heat diffuser cavity provides a flow path for the heat transfer oil from the heat exchanger around the burner kettle via the spiral ring; and iv. an agitator located within the heat diffuser column for activating the material product.

2. The apparatus of claim 1 wherein the interior sidewall and exterior side wall of the exterior burner kettle barrel are separated by a cavity, wherein the cavity contains high temperature insulation.

3. The apparatus of claim 1 wherein the closed top end of the burner kettle includes a hatch for receiving the heatable material product.

4. The apparatus of claim 1 wherein the depth of the bottom plate of the exterior burner kettle is thicker than the sidewall of the burner kettle to inhibit burn out.

5. The apparatus of claim 1 wherein the restriction baffle ring comprises an air exit chimney for drawing air through the restriction baffle ring cavity.

6. The apparatus of claim 1 wherein the restriction baffles comprise a series of incomplete rings attached to the outer surface of the restriction baffle ring wall.

7. The apparatus of claim 1 wherein the heat diffuser column further includes a center column extending from the floor surface for further circulation of heat transfer oil from the heat exchanger.

8. The apparatus of claim 7 wherein the agitator comprises paddles rotating around a paddle shaft, wherein the paddle shaft is rotatably activated an agitator motor.

9. The apparatus of claim 8 wherein the paddle shaft is rotatably placed within the center column of the heat diffuser column.

10. The apparatus of claim 1 wherein the closed floor surface of the heat diffuser column comprises a series of inline slots to draw the material product through the closed floor surface of the heat diffuser column.

11. The apparatus of claim 10 wherein the heat diffuser column further includes an exit pipe connected to the inline slots for transferring heated material product from the heat diffuser column.

12. The apparatus of claim 1 wherein the burner barrel further comprises a vented expansion tank to accommodate expansion and contraction of heat transfer oil in the burner barrel.

13. A hot mix melt crack sealing apparatus comprising:

a. a trailer frame including a generally rectangular trailer frame body and a triangular tongue, wherein the trailer frame rests on a least one axle supported by wheels;

b. a power unit for providing power to the apparatus;

c. a series of hydraulic pumps activated by the power unit, wherein the hydraulic pumps supply hydraulic fluid to at least one asphalt material pump, an agitator motor, and a heat transfer oil circulation pump;

d. a heat exchanger for heating heat transfer oil, e. a burner barrel for melting asphalt material product, the burner barrel comprising:

i. an exterior burner kettle barrel, wherein the burner kettle includes a bottom plate; an exterior sidewall, an interior sidewall, and a closed top end between the sidewalls;

ii. a restriction baffle ring comprising a restriction baffle ring wall, including a lower end, an upper end, an interior surface, and an exterior surface with an outwardly extending lip, wherein the exterior surface comprises restriction baffles adapted to create a heat path for heating heat transfer oil circulating around the burner kettle apparatus, wherein the restriction baffle ring is nested within the burner kettle barrel to create an internal restriction baffle ring cavity containing the restriction baffles for receiving hot air supplied by the heat exchanger;

iii. a heat diffuser column comprising a heat diffuser column wall, comprising an inner surface, an outer surface, a closed floor surface having an extended outward lip and an open top surface having an extended outward lip, wherein the outer surface of the heat diffuser wall comprises spiral ring, wherein the heat diffuser column is nested within the restriction baffle ring such that the upper and lower lips of the heat diffuser column sealingly engage with the interior surface of the restriction baffle ring to form a heat diffuser column cavity including the spiral ring, wherein the heat diffuser column cavity provides a flow path for the heat transfer oil from the heat exchanger around the burner kettle via the spiral ring; and iv. an agitator located within the heat diffuser column for activating the material product;

f. at least one material asphalt pump for transferring molten asphalt material from the burner barrel to an applicator hose;

g. an oven comprising application hoses; and h. a control panel for controlling the power unit operation, material pump operation, and agitator operation.

14. The apparatus of claim 13 further comprising a heat transfer oil circulation pump for circulating heat transfer oil across a burner box to maximize heat transfer prior to the heat transfer oil flowing into the burner barrel.

15. The apparatus of claim 13 wherein the material pump is a helical gear pump with a jacketed housing for receiving heat transfer oil to heat the material pump.

16. The apparatus of claim 13 wherein the interior sidewall and exterior side wall of the exterior burner kettle barrel are separated by a cavity, wherein the cavity contains high temperature insulation.

17. The apparatus of claim 13 wherein the closed top end of the burner kettle includes a hatch for receiving the heatable material product.

18. The apparatus of claim 13 wherein the depth of the bottom plate of the exterior burner kettle is thicker than the sidewall of the burner kettle to inhibit burn out.

19. The apparatus of claim 13 wherein the restriction baffle ring comprises an air exit chimney for drawing air through the restriction baffle ring cavity.

20. The apparatus of claim 13 wherein the restriction baffles comprise a series of incomplete rings attached to the outer surface of the restriction baffle ring wall.

21. The apparatus of claim 13 wherein the heat diffuser column further includes a center column extending from the floor surface for further circulation of heat transfer oil from the heat exchanger.

22. The apparatus of claim 21 wherein the agitator comprises paddles rotating around a paddle shaft, wherein the paddle shaft is rotatably activated an agitator motor.

23. The apparatus of claim 22 wherein the paddle shaft is rotatably placed within the center column of the heat diffuser column.

24. The apparatus of claim 13 wherein the closed floor surface of the heat diffuser column comprises a series of inline slots to draw the material product through the closed floor surface of the heat diffuser column.

25. The apparatus of claim 24 wherein the heat diffuser column further includes an exit pipe connected to the inline slots for transferring heated material product from the heat diffuser column.

26. The apparatus of claim 13 wherein the burner barrel further comprises a vented expansion tank to accommodate expansion and contraction of heat transfer oil in the burner barrel.

27. An apparatus for heating a heatable material product such as asphalt or a similar fluid, comprising:

a. a heat exchanger for heating heat transfer oil, wherein the heat transfer oil is directed to a heat diffuser column;

b. a burner barrel comprising:

i. an exterior burner kettle barrel, wherein the burner kettle includes a bottom plate; an exterior sidewall, an interior sidewall, and an closed top end between the sidewalls, wherein the interior sidewall and exterior side wall of the exterior burner kettle barrel are separated by a cavity, wherein the cavity contains high temperature insulation;

ii. a restriction baffle ring comprising a restriction baffle ring wall, including a lower end, an upper end, an interior surface, and an exterior surface with an outwardly extending lip, wherein the exterior surface comprises restriction baffles adapted to create a heat path for heating heat transfer oil circulating around the burner kettle apparatus, wherein the restriction baffle ring is nested within the burner kettle barrel to create an internal restriction baffle ring cavity containing the restriction baffles for receiving hot air supplied by the heat exchanger, and wherein the restriction baffles comprise a series of incomplete rings attached to the outer surface of the restriction baffle ring wall;

iii. the heat diffuser column comprising a heat diffuser column wall, comprising an inner surface, an outer surface, a closed floor surface having an extended outward lip and an open top surface having an extended outward lip, wherein the outer surface of the heat diffuser wall comprises spiral ring, wherein the heat diffuser column is nested within the restriction baffle ring such that the upper and lower lips of the heat diffuser column sealingly engage with the interior surface of the restriction baffle ring to form a heat diffuser column cavity including the spiral ring, wherein the heat diffuser column cavity provides a flow path for the heat transfer oil from the heat exchanger around the burner kettle via the spiral ring, wherein the heat diffuser column further includes a center column extending from the floor surface for further circulation of heat transfer oil from the heat exchanger, and wherein the closed floor surface of the heat diffuser column comprises a series of inline slots to draw the material product through the closed floor surface of the heat diffuser column; and iv. an agitator located within the heat diffuser column for activating the material product, wherein the agitator comprises paddles rotating around a paddle shaft, wherein the paddle shaft is rotatably activated an agitator motor, and wherein the paddle shaft is rotatably placed within the center column of the heat diffuser column.

28. The apparatus of claim 27 wherein the closed top end of the burner kettle includes a hatch for receiving the heatable material product.

29. The apparatus of claim 27 wherein the depth of the bottom plate of the exterior burner kettle is thicker than the sidewall of the burner kettle to inhibit burn out.

30. The apparatus of claim 27 wherein the restriction baffle ring comprises an air exit chimney for drawing air through the restriction baffle ring cavity.

* * * * *